US012018674B2

(12) United States Patent
Hu et al.

(10) Patent No.: US 12,018,674 B2
(45) Date of Patent: Jun. 25, 2024

(54) APPARATUS AND METHOD FOR CONTROLLING COMPRESSOR

(71) Applicant: LG ELECTRONICS INC., Seoul (KR)

(72) Inventors: Jinseok Hu, Seoul (KR); Young Doo Kim, Seoul (KR); Jae Jun You, Seoul (KR); Koonseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 524 days.

(21) Appl. No.: 17/371,861

(22) Filed: Jul. 9, 2021

(65) Prior Publication Data

US 2022/0049694 A1 Feb. 17, 2022

(30) Foreign Application Priority Data

Aug. 14, 2020 (KR) ..... 10-2020-0102374

(51) Int. Cl.

| | |
|---|---|
| ***F04B 49/20*** | (2006.01) |
| ***F04B 35/04*** | (2006.01) |
| ***F04B 49/02*** | (2006.01) |
| ***F04B 49/06*** | (2006.01) |

(52) U.S. Cl.

CPC ..... *F04B 49/20* (2013.01); *F04B 35/04* (2013.01); *F04B 49/02* (2013.01); *F04B 49/065* (2013.01); *F04B 2201/0201* (2013.01); *F04B 2203/0402* (2013.01); *F04B 2203/0408* (2013.01); *F04B 2207/043* (2013.01)

(58) Field of Classification Search

CPC .. F04B 35/04; F04B 49/02; F04B 2201/0201; F04B 2203/0408; F04B 2203/0402

See application file for complete search history.

(56) References Cited

U.S. PATENT DOCUMENTS

| | | | | | |
|---|---|---|---|---|---|
| 3,676,758 | A * | 7/1972 | Mathews | H02K 33/18 | 318/128 |
| 3,781,140 | A * | 12/1973 | Gladden | F04B 35/045 | 417/326 |
| 4,534,706 | A * | 8/1985 | Palm | F04B 47/02 | 417/42 |
| 4,772,838 | A * | 9/1988 | Maresca | B60L 15/005 | 318/135 |
| 5,017,854 | A * | 5/1991 | Gully | F04B 35/045 | 318/599 |
| 7,176,644 | B2 * | 2/2007 | Ueda | H02P 6/182 | 318/400.14 |

(Continued)

FOREIGN PATENT DOCUMENTS

| | | | |
|---|---|---|---|
| KR | 10-0783239 | B1 | 12/2007 |
| KR | 2009-0090249 | A | 8/2009 |

(Continued)

*Primary Examiner* — Christopher S Bobish

(74) *Attorney, Agent, or Firm* — KED & Associates LLP

(57) ABSTRACT

An apparatus and a method may control a compressor. The apparatus may control a motor (included in a compressor) such that the motor quickly repeats turn-on and turn-off operations in a cooling power supply time period/section, thereby enabling the compressor to compress refrigerant in the cooling power supply time period/section. Thus, cooling power of a refrigerator may change while the compressor operates with maximum efficiency.

17 Claims, 15 Drawing Sheets

(56) References Cited

U.S. PATENT DOCUMENTS

| | | | | |
|---|---|---|---|---|
| 7,184,254 | B2 * | 2/2007 | Dimanstein | F04B 35/045 361/600 |
| 7,218,068 | B2 * | 5/2007 | Fukuoka | F04D 15/0066 318/140 |
| 8,079,825 | B2 * | 12/2011 | Bocchiola | F04B 35/045 700/282 |
| 8,125,166 | B2 * | 2/2012 | Reinschke | H02P 25/032 318/135 |
| 8,134,330 | B2 * | 3/2012 | Alles | H02P 25/06 318/135 |
| 8,240,162 | B2 * | 8/2012 | Taras | F25B 49/022 62/228.4 |
| 8,657,587 | B2 * | 2/2014 | Sarkinen | A61M 5/14276 417/415 |
| 9,500,190 | B2 * | 11/2016 | Moreira-Espinoza | F04B 17/04 |
| 10,870,333 | B2 * | 12/2020 | Schumacher | B60H 1/3205 |
| 2011/0061411 | A1 | 3/2011 | Kim et al. | |
| 2016/0153442 | A1 | 6/2016 | Lim et al. | |

FOREIGN PATENT DOCUMENTS

| | | | |
|---|---|---|---|
| KR | 10-1698100 | B1 | 6/2016 |
| KR | 2020-0000105 | A | 1/2020 |

* cited by examiner

APPARATUS AND METHOD FOR CONTROLLING COMPRESSOR

CROSS-REFERENCE TO RELATED APPLICATION

This application claims priority to and the benefit of Korean Patent Application No. 10-2020-0102374, filed in Korea on Aug. 14, 2020, the subject matter of which is incorporated herein by reference in its entirety.

BACKGROUND

1. Field

Disclosed herein are an apparatus and a method for controlling a compressor provided in a refrigerator and including a motor and a piston.

2. Background

Compressors are mechanic devices that compress refrigerant or various types of operating gases to increase pressure. The compressors have been used for a variety of apparatuses such as a refrigerator, an air conditioner and the like.

The compressors can fall into different categories based on an inner structure and a theory of operation. In reciprocating compressors, a compressing space is formed between a piston and a cylinder, and operating gases are suctioned into and discharged from the compressing space. While the piston linearly reciprocates in the cylinder, refrigerant is compressed. In rotary compressors, a compressing space is formed between a roller and a cylinder, and operating gases are suctioned into and discharged from the compressing space. While the roller eccentrically rotates along an inner wall of the cylinder, refrigerant is compressed. In scroll compressors, a compressing space is formed between an orbiting scroll and a fixed scroll, and operating gases are suctioned into and discharged from the compression space. While the orbiting scroll rotates along the fixed scroll, refrigerant is compressed.

The reciprocating compressors can be divided into a recipro-type compressor and a linear-type compressor based on a way of driving the piston. In the recipro-type compressor, a crank shaft is coupled to a rotating motor, and a piston is coupled to the crank shaft, to change a rotational force of the rotating motor to a linearly reciprocating movement. In the linear-type compressor, a piston connects to a movable element of a linear motor directly, to change a linear movement of the motor to a reciprocating movement of a piston.

Unlike the recipro-type reciprocating compressor, the linear-type reciprocating compressor is provided with no crank shaft. Accordingly, the linear-type reciprocating compressor can ensure a reduction in friction loss and improvement of compression efficiency.

Refrigerators can operate in a wide range of temperatures, and need to provide different levels of cooling power depending on a range of temperatures. Accordingly, the compressors are designed and driven to have a wide range of cooling power variations. In particular, as the logic of a continuous operation of a compressor is developed, a range of cooling power variations becomes wider.

When cooling power of a compressor varies due to mechanical limitations, efficiency of the compressor can change, and a maximum efficiency of the compressor can not be maintained depending on cooling power of operation of the compressor.

FIG. 1 is a block diagram showing an apparatus for operating with a linear compressor according to related art. FIG. 2 is a graph showing a relationship between efficiency and a cooling power value of the linear compressor according to the related art. FIGS. 1 and 2 are disclosed in Korean Patent No. 10-1698100, the subject matter of which is incorporated herein by reference. Reference numerals in FIGS. 1 and 2 are given only to components therein.

Referring to FIG. 1, an apparatus for operating with a linear compressor includes a driver 110 configured to drive a linear compressor 200 based on a control signal, a detector 120 configured to detect input information of the linear compressor 200, and a controller 140 configured to control the driver 110 using the output information. The controller 140 outputs a command control signal, and the driver 110 drives the compressor 200 to follow the command control signal. In this example, the compressor 200 continues to operate based on the S-PWM method.

FIG. 2 shows the compressor of the related art that can control cooling power in the entire cooling power section. However, as described above, operation efficiency deteriorates toward a low cooling power section while the compressor operates at an optimal energy efficiency ratio (EER) since a mechanical resonance point and an electric input are the same near a relatively high cooling power section of 70%.

BRIEF DESCRIPTION OF THE DRAWINGS

Embodiments will be described in detail with reference to the following drawings in which like reference numerals refer to like elements, and wherein.

DETAILED DESCRIPTION

Figure 1:
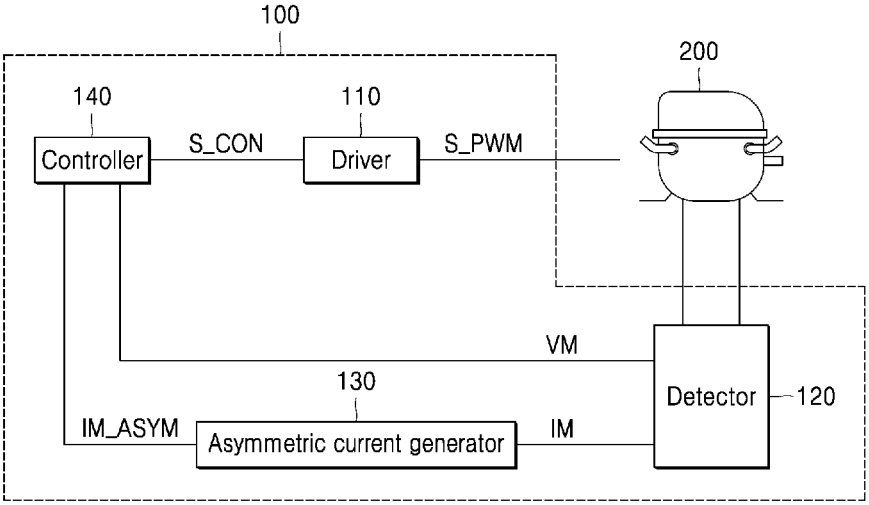
FIG. 1 PRIOR ART
FIG. 1 is a block diagram showing an apparatus for operating with a linear compressor according to related art.
Figure 2:
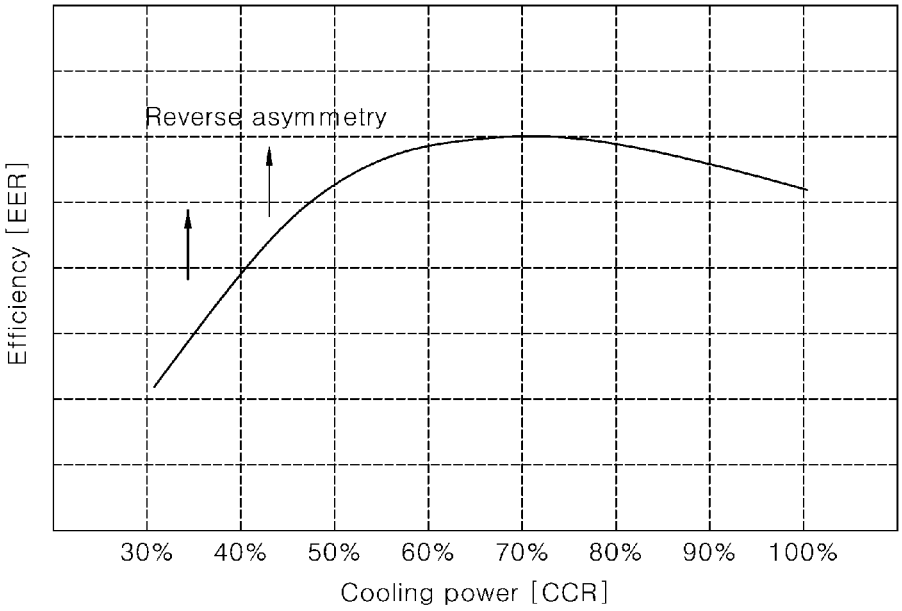
FIG. 2 PRIOR ART
FIG. 2 is a graph showing a relationship between efficiency and a cooling power value of the linear compressor according to related art.

Aspects, features and advantages are specifically described hereunder with reference to the accompanying drawings such that one having ordinary skill in the art to which the present disclosure pertains can easily implement the technical spirit of the disclosure. In the disclosure, detailed description of known technologies in relation to the disclosure may be omitted if it is deemed to make the gist of the disclosure unnecessarily vague. In the drawings, identical reference numerals can denote identical or similar components.

Figure 3:
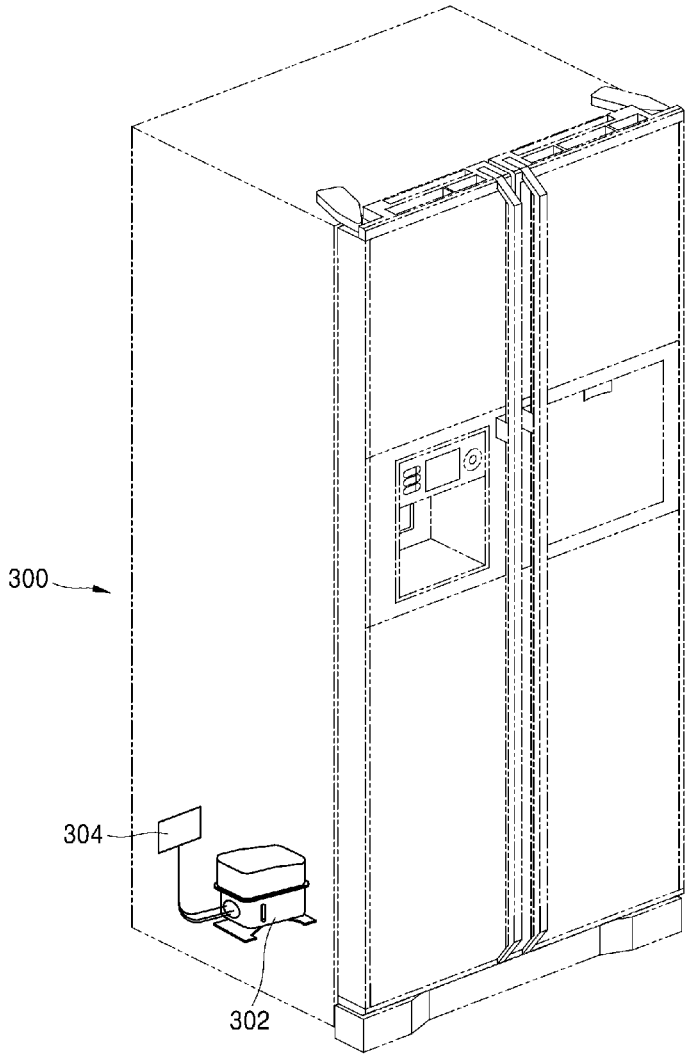
FIG. 3 is a perspective view showing a refrigerator including a reciprocating compressor in one embodiment.

FIG. 3 is a perspective view showing a refrigerator including a reciprocating compressor in one embodiment. As shown in FIG. 3, a refrigerator 300 in one embodiment may be provided therein with an apparatus 304 configured to control an operation of the refrigerator 300. The apparatus 304 for controlling a reciprocating compressor according to the disclosure, described hereunder, may be implemented in the form of a circuit or a module on a main substrate. The main substrate may electrically connect to a reciprocating compressor 302.

The refrigerator 300 may operate as a result of driving of the reciprocating compressor 302. To keep an inner storage of the refrigerator 300 cool, cool air needs to be supplied into the storage. To supply cool air, the reciprocating compressor 302 may suction and compress gaseous refrigerant, and the compressed high-temperature/high-pressure refrigerant may be liquefied while passing through a condenser. The refrigerant coming out of the condenser may lower a temperature of air around an evaporator as a result of heat exchange while passing through the evaporator to generate cool air. The refrigerant having passed through the evaporator may be supplied to the reciprocating compressor 302 again. Refrigerant may circulate as described above. Based on repetition of the above circulation, cool air may be supplied into the storage of the refrigerator 300.

Figure 4:
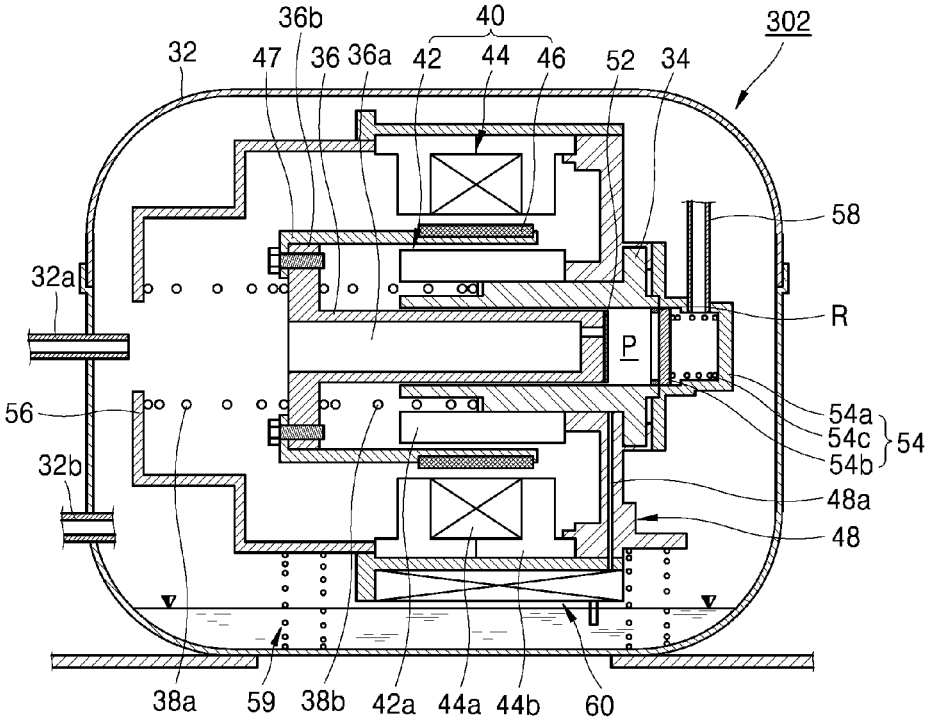
FIG. 4 is a cross-sectional view showing the reciprocating compressor in one embodiment.

FIG. 4 is a cross-sectional view showing the reciprocating compressor 302 in one embodiment. As shown in FIG. 4, the reciprocating compressor 302 may be a linear compressor and may include an airtight container 32 forming an exterior of the reciprocating compressor 302. An inlet tube 32*a* through which refrigerant are introduced and an outlet tube 32*b* through which refrigerant are discharged may be disposed on one side of the airtight container 32.

A cylinder 34 may be installed inside the airtight container 32 in a fixed manner. A piston 36 may be disposed in the cylinder 34. The piston 36 may compress refrigerant, suctioned into a compressing space P in the cylinder 34, as a result of reciprocation.

A spring 38*a*, 38*b* configured to elastically support the piston 36 in a direction of movement of the piston 36 may be disposed at one end of the piston 36. The piston 36 may connect to a motor 40 configured to generate a driving force, and may reciprocate as a result of driving of the motor 40.

A suction valve 52 may be disposed at one end of the piston 36 in contact with the compressing space P, and a discharge valve assembly 54 may be disposed at one end of the cylinder 34 in contact with the compressing space P. Each of the suction valve 52 and the discharge valve assembly 54 may be automatically controlled such that the suction valve 52 and the discharge valve assembly 54 are respectively opened and closed depending on a pressure in the compressing space P.

Oil may be accommodated at a bottom in the airtight container 32, and an oil supply device 60 for pumping oil may be arranged in the airtight container 32. An oil supply tube 48*a* configured to supply oil between the piston 36 and the cylinder 34 may be formed in a lower frame 48 of the airtight container 32. The oil supply device 60 may pump oil using vibrations generated as a result of reciprocation of the piston 36, and for cooling and lubrication, the pumped oil may be supplied to a gap between the piston 36 and the cylinder 34 along the oil supply tube 48*a*.

The cylinder 34 may be formed into a hollow hole to allow the piston 36 to reciprocate and have the compressing space P therein. The cylinder 34 and the inlet tube 32*a* may be arranged on the same straight line in a state in which one end of the cylinder 34 is adjacent to an inside of the inlet tube 32*a*.

The discharge valve assembly 54 may be disposed at one end of the cylinder 34 arranged on the opposite side of the inlet tube 32*a*. The discharge valve assembly 54 may include a discharge cover 54*a* having a predetermined discharge space toward one end of the cylinder 34, a discharge valve 54*b* configured to open and close one end thereof toward the compressing space P of the cylinder, and a valve spring 54*c* configured to exert an elastic force between the discharge cover 54*a* and the discharge valve 54*b* in an axial direction. An O-ring R may be fitted into an inner circumferential surface of one end of the cylinder 34 to bring the discharge valve 54*b* into contact with the cylinder 34.

A loop pipe 58 having a curvy shape may connect between one side of the discharge cover 54*a* and the outlet tube 32*b*. The loop pipe 58 may guide compressed refrigerant such that the compressed refrigerant are discharged outward and buffer the impact of vibrations caused by an interaction among the cylinder 34, the piston 36 and the motor 40 on the airtight container 32.

When a pressure of the compressing space P reaches a predetermined discharge pressure as a result of reciprocation of the piston 36 in the cylinder 34, the valve spring 54*c* may be compressed, and the discharge valve 54*b* may be opened. Accordingly, refrigerant compressed in the compressing space P may be discharged out of the compressing space P, and the compressed refrigerant discharged from the compressing space P may be discharged outward along the loop pipe 58 and the outlet tube 32*b*.

Refrigerant introduced through the inlet tube 32*a* may flow into the compressing space P through a refrigerant channel 36*a* formed at a center of the piston 36. One end of the piston 36 near the inlet tube 32*a* may directly connect to the motor 40 through a connection member 47. The suction valve 52 may be formed into a thin plate and may have a central portion partially cut to open and close the refrigerant channel 36*a* of the piston 36, and one side of the suction valve 52 may be fixed to one end of the piston 36 by a screw.

When a pressure of the compressing space P is a predetermined suction pressure (less than the discharge pressure) or less as a result of reciprocation of the piston 36 in the cylinder 34, the suction valve 52 may be opened and refrigerant may be suctioned into the compressing space P. When the pressure of the compressing space P reaches the predetermined suction pressure, the suction valve 52 may be closed and the refrigerant may be compressed in the compressing space P.

The piston 36 may be installed in a way such that the piston 36 is elastically supported in a direction of movement thereof. Specifically, a piston flange 36*b* protruding radially at one end of the piston 36 adjacent to the inlet tube 32*a* may be elastically supported in the direction of movement of the piston 36 by the (mechanical) spring 38*a*, 38*b* such as a coil spring and the like, and the refrigerant included in the compressing space P on the opposite side of the inlet tube 32*a* may serve as a gas spring and elastically support the piston 36 using its own elastic force.

The motor 40 may be a linear motor, and may include an inner stator 42, an outer stator 44, and a permanent magnet 46. The inner stator 42 may be configured such that a plurality of laminations 42*a* is stacked circumferentially and may be fixed to an outside of the cylinder 34 by the frame 48. The outer stator 44 may be configured such that a plurality of laminations 44*b* is stacked circumferentially around a coil winding body 44*a* configured to allow a coil to be wound and arranged outside the cylinder 34 by the frame 48 with a gap between the outer stator 44 and the inner stator 42. The permanent magnet 46 may be disposed in a gap between the outer stator 44 and the inner stator 42 and connected to the piston 36 by the connection member 47. Depending on embodiments, the coil winding body 44*a* may be disposed outside the inner stator 42 in a fixed manner.

An administration cycle of the reciprocating compressor 302, and a change in forces applied to the piston 36 in each administration cycle may be described with reference to FIGS. 5 and 6.

Figure 5:
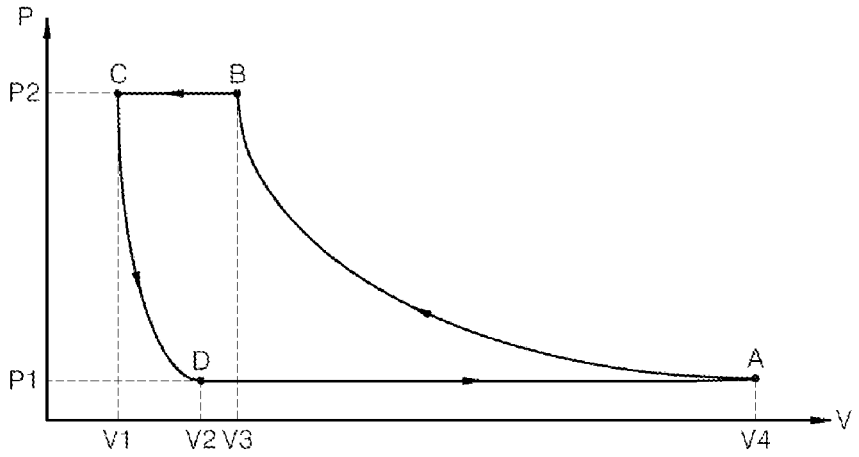
FIG. 5 is a PV diagram based on an administration cycle of a reciprocating compressor.

FIG. 5 is a PV (pressure and volume) diagram based on an administration cycle of a reciprocating compressor. FIG. 6 is a graph showing positions of a piston and a change in force applied to the piston, based on an administration cycle of a reciprocating compressor.

The administration cycle of the reciprocating compressor 302 may be divided into a compression administration and a suction administration. In the PV diagram of FIG. 5, the administration cycle of the reciprocating compressor 302 is expressed in the order of "A→B→C→D". Additionally, in the PV diagram of FIG. 5, the horizontal axis V denotes volume of refrigerant in the compressing space, and the vertical axis P denotes pressure in the compressing space.

In a state in which the piston 36 is at a bottom dead center (BDC) in the cylinder 34, the suction valve 52 may be opened, and refrigerant may flow into the cylinder 34. In this case, volume of the refrigerant is indicated by V4, and pressure in the compressing space is indicated by P1 (point A).

When the inflow of the refrigerant is completed, the suction valve 52 may be closed, the piston 36 may linearly move from the BDC to a top dead center TDC, and the refrigerant in the compressing space P may be gradually compressed (A→B section). Accordingly, the pressure in the compressing space P may increase (P1→P2) and the volume of the refrigerant may decrease (V4→V3).

When the piston 36 reaches at the TDC (point B), the discharge valve 54*b* may start to open. In this case, the piston 36 may stay at the TDC until the discharge valve 54*b* is completely opened (point C). Thus, the volume of the refrigerant may continue to decrease to V1 (V3→V1; B→C section) as a result of discharge of the refrigerant while the pressure in the compressing space P is maintained (P2).

Then, when the discharge valve 54*b* is completely opened, the compressed refrigerant may be totally discharged outward through the discharge valve 54*b*. Accordingly, the pressure in the compressing space P may decrease from P2 to P1, and the discharge valve 54*b* may be closed (C→D section).

When the discharge valve 54*b* is closed, the piston 36 may linearly move again toward the BDC. Accordingly, the compressing space P may become wide, and while the pressure in the compressing space P is maintained P1, the volume may gradually increase (V2→V4; D→A section). When the piston 36 reaches the BDC (point A), the suction valve 52 may be opened, and the inflow of the refrigerant may start again.

The reciprocating compressor 302 may repeat the above compression administration (A→B→C section) and the above suction administration (C→D→A section). The apparatus 304 (for controlling the reciprocating compressor) may set the compression administration section and the suction administration section of the reciprocating compressor 302 as a "control section", and adjust magnitude of an AC voltage supplied to the piston 36 in each control section to control magnitude of a force applied to the piston 36.

Figure 6:
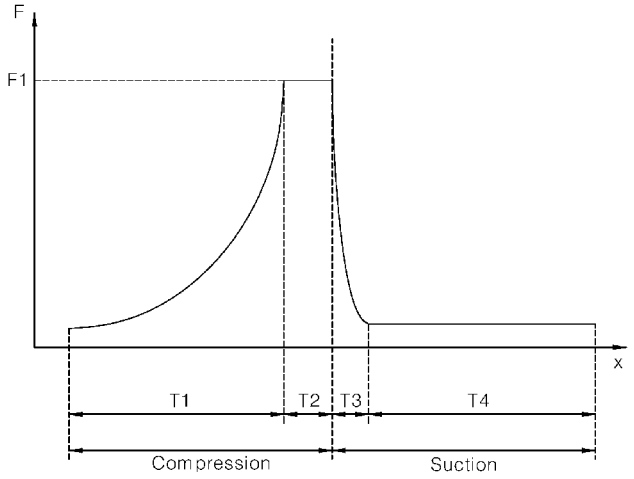
FIG. 6 is a graph showing positions of a piston and a change in force applied to the piston based on an administration cycle of a reciprocating compressor.

FIG. 6 shows the control section set by the apparatus 304 for controlling the reciprocating compressor. The control section may correspond to the compression administration section (A→B→C section) and the suction administration section (C→D→A section), which are described above with reference to FIG. 5.

Referring to FIG. 6, the control section may include a compression administration control section and a suction administration control section. The compression administration control section may include a first compression administration control section T1 and a second compression administration control section T2. The suction administration control section may include a first suction administration control section T3 and a second suction administration control section T4.

The first compression administration control section T1 may correspond to the A→B section in FIG. 5 (i.e., a section in which the piston 36 linearly moves from the BDC to the TDC). The apparatus 304 (for controlling the reciprocating compressor) may increase magnitude of an AC voltage supplied to the motor 40 by a first predetermined offset to increase a force applied to the piston 36 during the first compression administration control section T1. Accordingly, the piston 36 may move more readily toward the TDC.

The second compression administration control section T2 may correspond to the B→C section in FIG. 5 (i.e., a section in which the piston 36 reaches the TDC and stays at the TDC for a certain period of time). The apparatus 304 (for controlling the reciprocating compressor) may maintain magnitude of an AC voltage applied to the motor 40 at a first predetermined voltage value to keep a force applied to the piston 36 constant during the second compression administration control section T2. Accordingly, in B→C section where the piston 36 needs to stand still at the TDC, the piston 36 may be prevented from escaping out of the TDC, and refrigerant may be prevented from being overly compressed.

The first suction administration control section T3 may correspond to the C→D section in FIG. 5 (i.e., a section in which the piston 36 linearly moves from the TDC to the BDC). The apparatus 304 (for controlling the reciprocating compressor) may increase magnitude of an AC voltage supplied to the motor 40 by a second predetermined offset to increase a force applied to the piston 36 during the first suction administration control section T3. Accordingly, the piston 36 may move more readily toward the BDC.

The second suction administration control section T4 may be D→A section in FIG. 5 (i.e., a section in which the piston 36 reaches the BDC and stays at the BDC for a certain period of time). The apparatus 304 (for controlling the reciprocating compressor) may maintain magnitude of an AC voltage applied to the motor 40 at a second predetermined voltage value to keep a force applied to the piston 36 constant during the second suction administration control section T4. Accordingly, in D→A section where the piston 36 needs to stand still at the BDC, the piston 36 may be prevented from escaping out of the BDC.

Figure 7A:
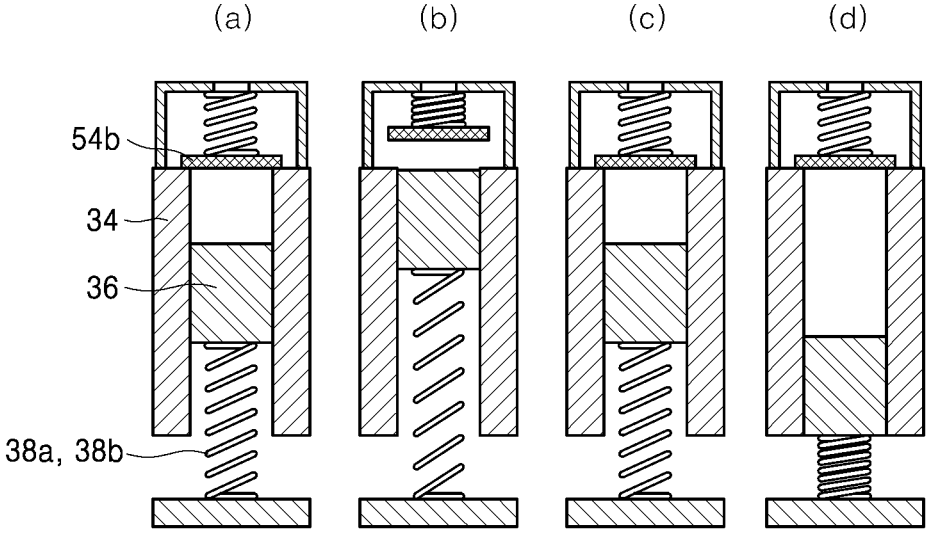
FIGS. 7A and 7B show positions of a piston and waveforms of current supplied to a motor based on an administration cycle of a reciprocating compressor.
Figure 7B:
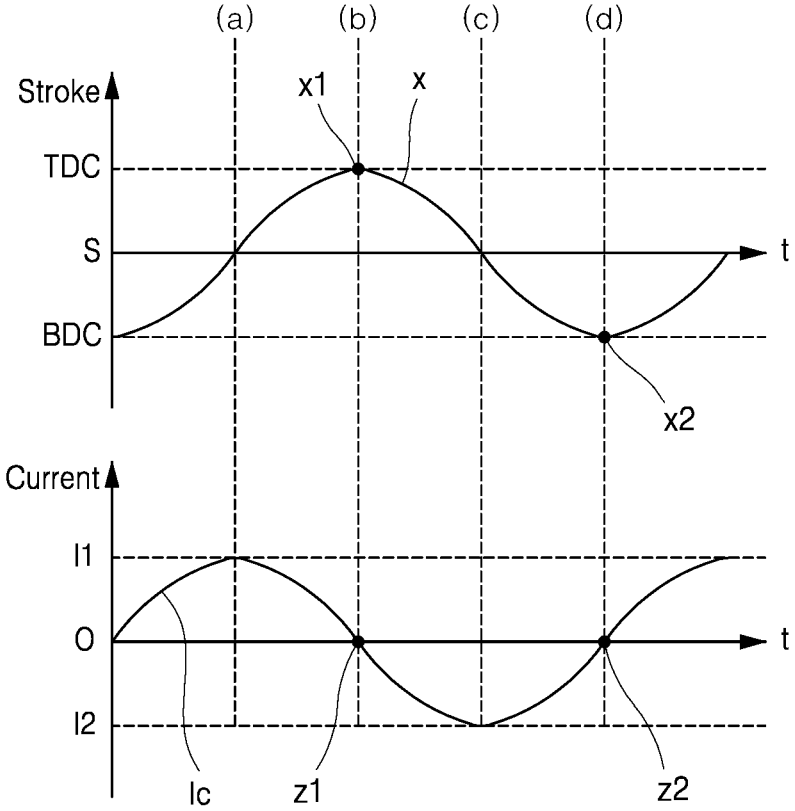

FIGS. 7A and 7B show positions of a piston 36 and waveforms of current supplied to a motor 40 based on an administration cycle of a reciprocating compressor. FIG. 7A shows positions ((a)-(d)) of the piston 36 in the cylinder 34 based on the administration cycle. FIG. 7B shows estimated strokes x of the piston 36 and waveforms of driving current Ic supplied to the motor 40 respectively based on the administration cycle.

As shown, the piston 36 may reciprocate in the compressing space of the cylinder 34. In this case, it is assumed that an operation frequency of the compressor 302 matches a resonance frequency of the compressor 302 and that the piston 36 reciprocates ideally.

Position (a) in FIGS. 7A and 7B shows that the piston 36 is at an initial point S in the compression administration cycle while moving from the BDC to the TDC. The initial point S may be defined as a middle point between the TDC and the BDC, but is not limited thereto. The initial point S may be defined as another point (rather than the middle point) between the TDC and the BDC.

As shown in FIG. 7B, when the piston 36 is at the initial point S, the driving current Ic supplied to the motor 40 is provided at a maximum value I1. That is, when the piston 36 is at the initial point S, a maximum force may be supplied to the piston 36 by the motor 40. In FIG. 7A, the piston 36 may linearly move toward the TDC using the force supplied by the motor 40 and the elastic force applied by the spring 38*a*, 38*b*.

Position (b) in FIGS. 7A and 7B shows that the piston 36 is at the TDC in the compression administration cycle. In this case, the piston 36 may stand still (or maintained) at the TDC for a certain period of time, the discharge valve 54*b* may be opened, and refrigerant compressed in the cylinder 34 may be discharged outward.

When the piston 36 moves in a direction toward the TDC past the initial point S (i.e., when the piston 36 moves linearly from the position (a) to the position (b)), the magnitude of driving current Ic supplied to the motor 40 may be maintained at a value between the maximum value I1 and 0 (i.e., a value greater than 0). Thereafter, when the piston 36 reaches the TDC, the magnitude of the driving current Ic becomes 0, and the motor 40 driven force is not supplied to the piston 36.

Position (c) in FIGS. 7A and 7B shows that the piston 36 is at the initial point S in the suction administration cycle while moving from the TDC to the BDC. When the piston 36 moves in a direction toward the BDC (i.e., when the piston 36 moves linearly from the position (b) to the position (c)), the magnitude of driving current Ic supplied to the motor 40 may be maintained at a value between 0 and a minimum value I2 (i.e., a value less than 0). Thereafter, when the piston 36 reaches the initial point S, the magnitude of the driving current Ic may be the minimum value I2. That is, when the piston 36 is at the initial point S, the motor 40 may supply a maximum force to the piston 36.

Position (d) in FIGS. 7A and 7B shows that the piston 36 is at the BDC in the suction administration cycle. When the piston 36 moves in a direction toward the BDC past the initial point S (i.e., when the piston 36 moves linearly from the position (c) to the position (d)), the magnitude of driving current Ic supplied to the motor 40 may be maintained at a value between the minimum value I2 and 0 (i.e., a value less than 0). Thereafter, when the piston 36 reaches the BDC, the magnitude of the driving current Ic becomes 0, and the motor 40 driven force is not supplied to the piston 36.

Magnitude of driving current Ic may be maintained at a value greater than 0 while the piston 36 moves toward the TDC, and maintained at a value less than 0 while the piston 36 moves toward the BDC. Additionally, while the piston 36 is positioned at one of the two dead centers DC (i.e., top dead center (TDC) and bottom dead center (BDC)), the force by the motor 40 is not supplied to the piston 36, and the magnitude of driving current Ic is maintained at 0.

A refrigerator may operate in a wide range of temperatures and needs to supply various magnitude ranges of cooling power depending on a range of temperatures. In this case, the compressor may achieve maximum operation efficiency in a specific section, and accordingly, the operation efficiency of the compressor may deteriorate when the cooling power of the refrigerator changes.

Figure 8A:
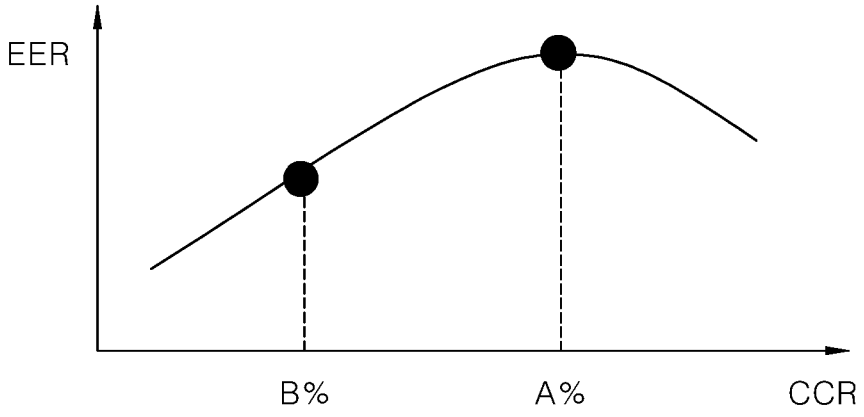
FIGS. 8A and 8B are views showing a relationship between a CCR and an EER of a compressor, and a relationship between the CCR of the compressor and a friction loss ratio of the compressor.
Figure 8B:
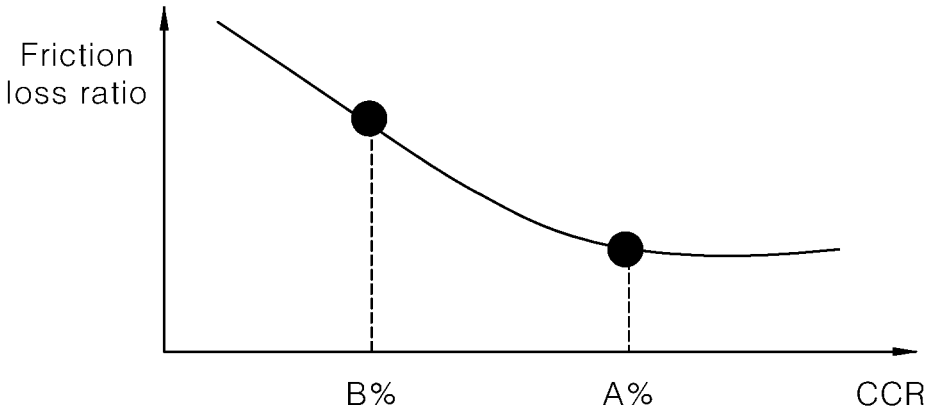

FIGS. 8A and 8B are views showing a relationship (FIG. 8A) between a cooling capacity ratio CCR and an energy efficiency ratio EER of the compressor, and a relationship (FIG. 8B) between the CCR of the compressor and a friction loss ratio of the compressor.

The efficiency of the compressor may be defined as electric input supplied to the compressor and output cooling power of the compressor. The electric input may be defined as a total of compression input of the refrigerant, operation input of the motor, loss of the motor (copper loss and iron loss), mechanical loss (friction loss), driving loss (component loss) and the like.

A deterioration in the efficiency of a compressor depending on the CCR of the compressor is due to the fact that the loss described above is not reduced at the same rate as a rate of a change in output cooling power. In particular, to reduce the friction loss ratio, an initial position or mechanical specifications of a piston needs to be changed. However, despite a change in the mechanical specifications, improvement in the efficiency of the compressor may be hardly ensured in the entire cooling power section.

Embodiments according to the present disclosure that may vary cooling power while keeping the compressor 302 operating with maximum efficiency, as may be described.

Figure 9:
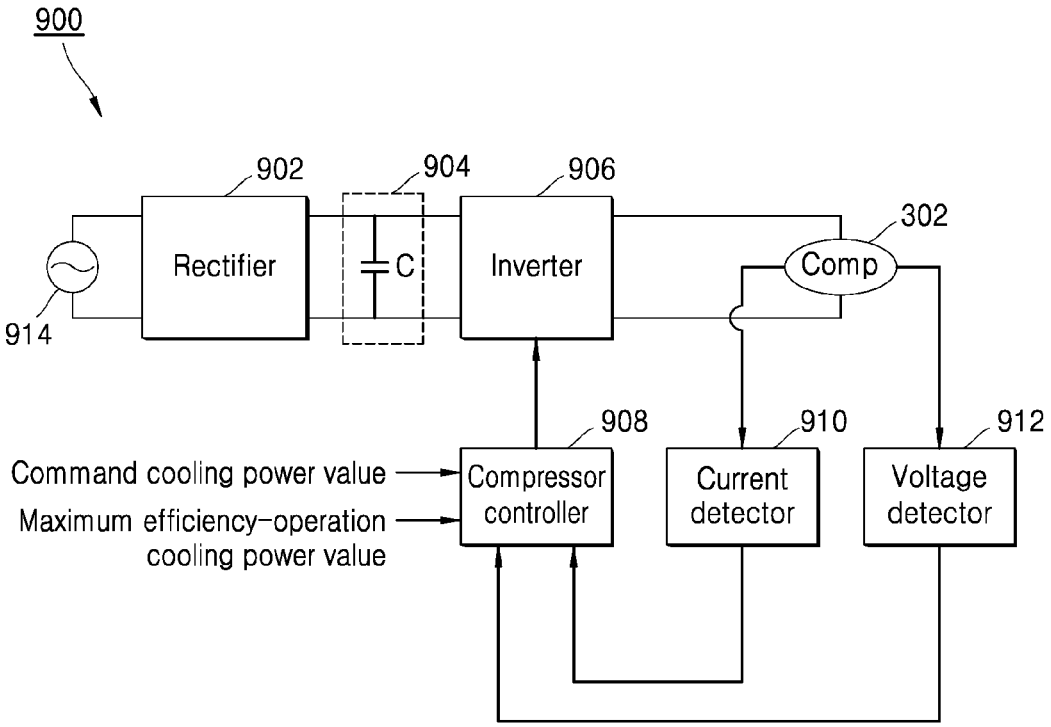
FIG. 9 is a view showing a schematic configuration of an apparatus for controlling a compressor in one embodiment.

FIG. 9 is a view showing a schematic configuration of an apparatus 900 for controlling a compressor in one embodiment. The apparatus 900 may include a rectifier 902, a smoother 904, an inverter 906, a compressor controller 908, a current detector 910 and a voltage detector 912.

The rectifier 902 may rectify AC power input from an external power source 914 and output a DC voltage. The smoother 904 may smooth the voltage output by the rectifier 902 and output a DC voltage. The smoother 904 may include a capacitor C configured to perform a smoothing operation.

The inverter 906 may transform the DC voltage output from the smoother 904 into an AC voltage and supply the AC voltage to the compressor 302. The motor 40 of the compressor 302 may be driven using the AC voltage supplied by the inverter 906. As a result of driving of the motor 40, the piston 36 may reciprocate. The inverter 906 may include at least one of switching elements.

The compressor controller 908 may send a first control signal to the inverter 906. The inverter 906 may be driven at a predetermined operation frequency and may supply the AC voltage to the motor 40 of the compressor 302 by the first control signal sent by the compressor controller 908. That is, magnitude of the AC voltage supplied to the compressor 302 may be adjusted by the first control signal sent by the compressor controller 908. As a result of adjustment of the magnitude of the AC voltage, the motor 40 driven reciprocation of the piston 36 may be controlled.

The current detector 910 may detect magnitude of driving current supplied to the motor 40 during the driving of the compressor 302. The voltage detector 912 may detect magnitude of a driving voltage supplied to the motor 40 during the driving of the compressor 302. The compressor controller 908 may estimate a position of the piston 36 (i.e., a stroke of the piston 36) based on at least one of the driving current and the driving voltage. For example, the compressor controller 908 may estimate a position of the piston 36 based on a counter electromotive force detected in the motor 40.

In one embodiment, the compressor controller 908 may generate the first control signal for controlling the compressor 302 based on command cooling power value of the compressor 302, maximum-efficiency operation cooling power value of the compressor 302, and/or estimated stroke of the piston 36, and may provide the first control signal to the inverter 906.

The command cooling power value may be received from a main controller of the refrigerator that is communicably connected to the compressor controller 908. The command cooling power value may correspond to an expected cooling power value of the compressor 302, which is set based on an external temperature, a temperature in the refrigerator and/or the like. The maximum-efficiency operation cooling power value may correspond to a cooling power value or a cooling capacity ratio $CCR_H$ when the compressor 302 is operating at maximum efficiency.

In one embodiment, such that the cooling power of the compressor 302 is changed while the compressor 302'*s* operation is maintained with maximum efficiency, the compressor controller 908 may quickly turn on and turn off the motor 40 in the compressor 302 in a time period/section where the cooling power is supplied.

A configuration and an operation of the compressor controller 908 may be specifically described with reference to FIGS. 10 to 12. The compressor 302 may perform a refrigerant compression operation for supplying cooling power during a cooling power supply time period (or section) and may not perform the refrigerant compression operation during a cooling power non-supply time period (or section) following the cooling power supply time period (or section).

Figure 10:
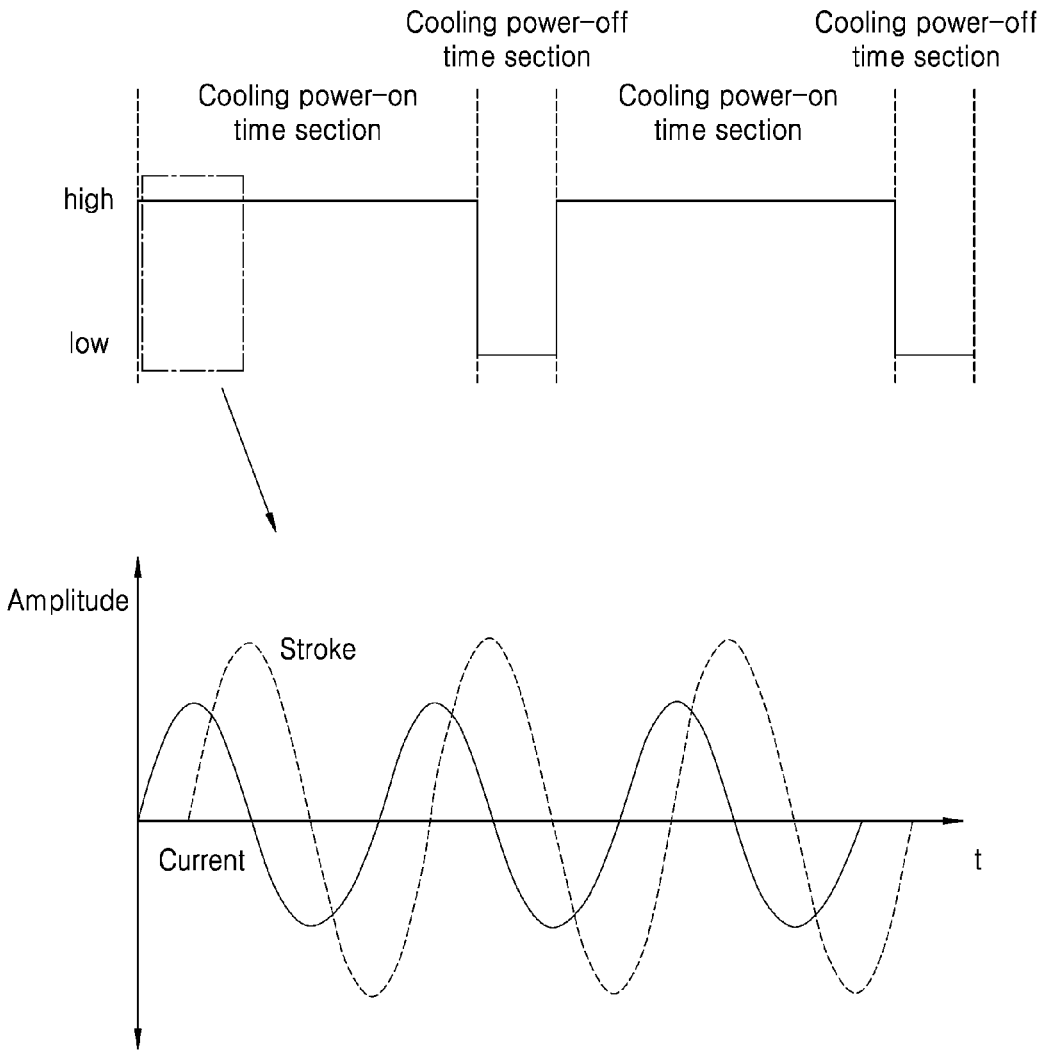
FIG. 10 is a view for describing a concept of a driving operation of a motor of the related art.

FIG. 10 is a view for describing a concept of a driving operation of a motor according to the related art. Referring to the upper graph in FIG. 10, in each cooling power supply time period/section (i.e., a cooling power-on time period/section), the motor in the compressor may always be turned on (high), the piston may make a reciprocating movement driven by the motor, and the compressor may compress refrigerant. Additionally, in each cooling power non-supply time period/section (i.e., a cooling power-off time period/section), the motor may be turned off (low), the piston may make no reciprocating movement, and the compressor may not compress refrigerant.

Referring to the lower graph in FIG. 10, in the entire cooling power supply time section, driving current corresponding to electric energy may be supplied to the motor, and the motor may be turned on. When the motor is turned on, the piston may reciprocate and the stroke of the piston may change.

The motor 40 according to the present disclosure may operate in a different way from operation of the motor of the related art in FIG. 10. For example, FIG. 11 is a view for describing a concept of a driving operation of the motor 40 according to the present disclosure. FIG. 11 shows a cooling power supply time period (also referred to as a cooling power supply time section) that includes a cooling power-on supply time period (also referred to as a cooling power-on supply time section) and a cooling power non-supply time period (also referred to as a cooling power non-supply time section). Referring to the upper graph in FIG. 11, in the cooling power supply time period/section, the compressor controller 908 may not always turn on the motor 40, and may control the motor 40 to quickly repeat an operation cycle in which the motor 40 is turned on (high) and then turned off (low). Additionally, in the cooling power non-supply time period/section, the motor 40 may be turned off (low).

Figure 11:
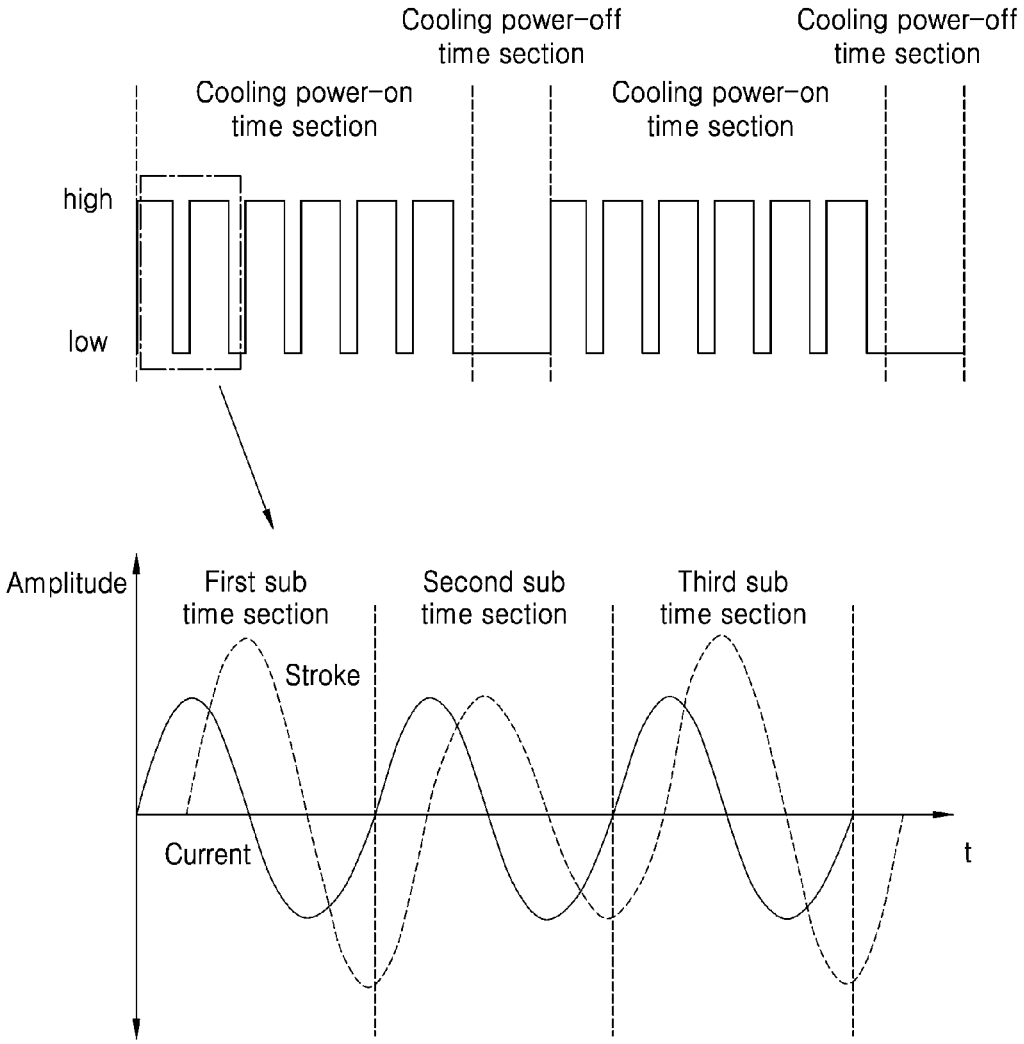
FIG. 11 is a view for describing a concept of a driving operation of a motor according to the present disclosure.

Referring to the lower graph in FIG. 11, the motor 40 may be supplied with no driving current all the time.

In a first sub time period/section of the cooling power supply time period/section, driving current corresponding to electric energy may be supplied to the motor 40, and the motor 40 may be turned on. When the motor 40 is turned on, the piston 36 may reciprocate, and a length of a stroke of the piston 36 may change. As a result of reciprocation of the piston 36, refrigerant may be compressed, and cooling power may be supplied.

In a second sub time period/section of the cooling power supply time period/section, no driving current may be supplied to the motor 40, and the motor 40 may be turned off. However, as the piston 36 reciprocates in the first sub time period/section, the piston 36 may obtain inertial energy or elastic energy in (or for) the second sub time period/section. Accordingly, in the second sub time period/section, the piston 36 may slowly stop reciprocating instead of immediately stopping reciprocating based on the inertial energy or the elastic energy. Magnitude of the elastic energy may be proportional to an elastic force of the spring 38*a*, 38*b* and mass of the motor 40.

When a duration of the second sub time period/section is set to a duration less than a period corresponding to a resonance frequency of the spring 38*a*, 38*b*, the piston 36 may keep reciprocating without stopping during the second sub time period/section. As a result of reciprocation of the piston 36, refrigerant may also be compressed during the second sub time period/section, and cooling power may be supplied.

Additionally, in a third sub time period/section of the cooling power supply time period/section, driving current may again be supplied to the motor 40. Accordingly, the motor 40 may be turned on, the piston 36 may reciprocate again using electric energy, refrigerant may be compressed, and cooling power may be supplied.

When the piston 36 reciprocates again using the electric energy during the third sub time period/section since the piston 36 reciprocates in the second sub time period/section, friction loss generated in the piston 36 may be reduced. Similarly, kinetic friction is smaller than static friction.

According to the present disclosure, the motor 40 may repeat quick turn-on and turn-off operations during the cooling power supply time period/section. In this case, when the motor 40 is turned off, the piston 36 may reciprocate using inertial energy or elastic energy. Accordingly, in the entire cooling power supply time period/section, the compressor 302 may compress refrigerant. The reciprocation of the piston 36, which is performed when the motor 40 is turned off, may help to reduce friction loss that is caused when the motor 40 is turned on at a following time point.

Driving of the compressor 302 needs to be controlled such that a current cooling power value of the refrigerator follows the command cooling power value. According to the present disclosure, a ratio (i.e., a first ratio) of the motor's turn-on time period/section to the motor's turn-off time period/section may be controlled during the cooling power supply time period/section to allow the current cooling power value of the refrigerator to follow the command cooling power value. In this case, the first ratio may be set based on the command cooling power value for the compressor 302 and the maximum-efficiency operation cooling power value of the compressor 302.

FIGS. 12A-12D are views for describing a concept of a cooling power supply as a result of driving of a compressor 302 in one embodiment. In FIGS. 12A-12D, an operation cooling power value may correspond to a cooling capacity ratio, and a maximum-efficiency operation cooling power value of the compressor may correspond to a cooling capacity ratio $CCR_H$ at a time when the compressor operates with maximum efficiency.

Figure 12A:
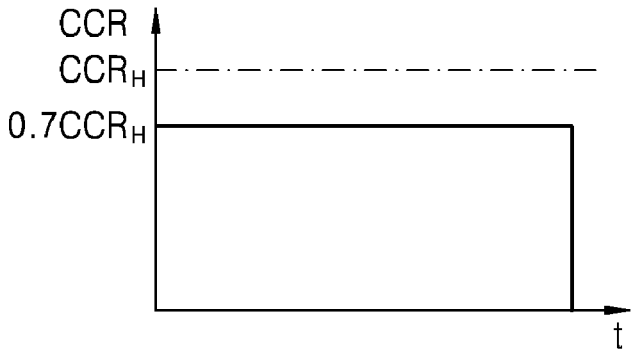
FIGS. 12A-12D are views for describing a concept of a cooling power supply as a result of driving of a compressor in one embodiment.
Figure 12B:
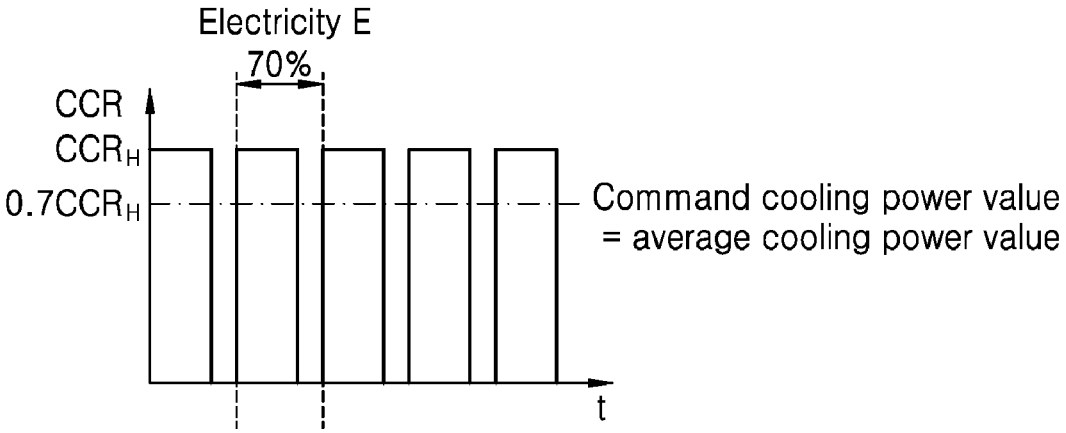
Figure 12C:
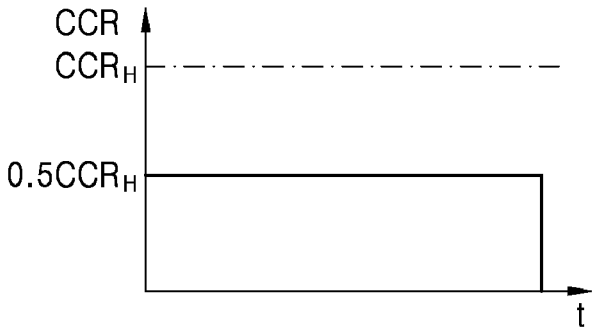

FIG. 12A and FIG. 12C shows a drive line of a motor according to the related art. Referring to FIGS. 12A and 12C, the motor may be always turned on during the cooling power supply time period/section, and the compressor may be driven to supply cooling power following the command cooling power value. Accordingly, when the command cooling power value is 0.7 times greater than the maximum-efficiency operation cooling power value of the compressor, the driving of the compressor may be controlled such that the compressor supplies cooling power of 0.7 $CCR_H$ (FIG. 12A). When the command cooling power value is 0.5 times greater than the maximum-efficiency operation cooling power value of the compressor, the driving of the compressor may be controlled such that the compressor supplies cooling power of 0.5 $CCR_H$ (FIG. 12C).

Figure 12D:
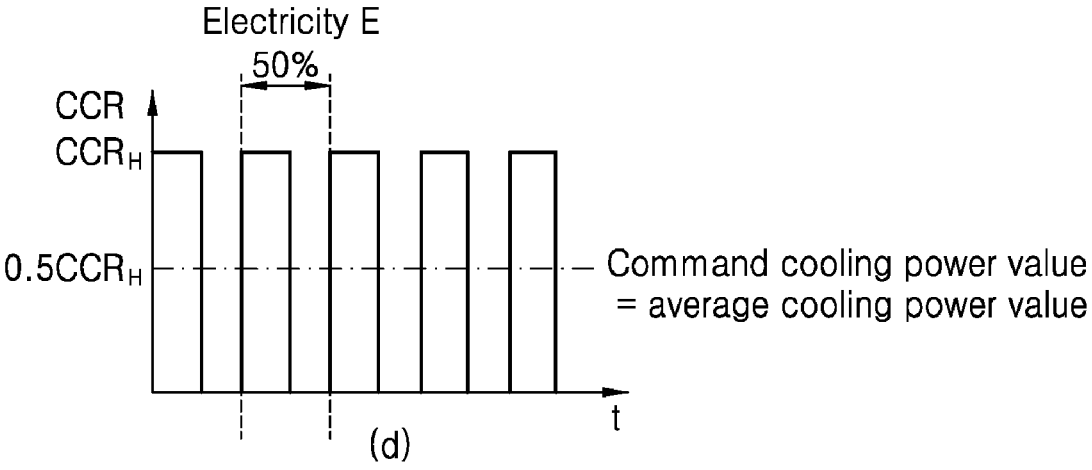

FIG. 12B and FIG. 12D shows a drive line of a motor 40 according to the present disclosure. Referring to FIGS. 12B and 12D, the compressor 302 may be driven such that cooling power based on the maximum-efficiency operation cooling power value (i.e., a maximum cooling capacity ratio $CCR_H$) is supplied in a motor's turn-on time section. The compressor controller 908 may set a ratio (i.e., a first ratio) of the motor's turn-on time period/section to the motor's turn-off time period/section. In this case, the compressor controller 908 may calculate the first ratio based on the command cooling power value and the maximum-efficiency operation cooling power value. Based on the calculated first ratio, an average cooling power value during the cooling power supply time period/section may be estimated and may correspond to the command cooling power value.

When the command cooling power value is 0.7 times greater than the maximum-efficiency operation cooling power value of the compressor, the motor 40 may be turned on during a time period/section that is approximately 70% of the cooling power supply time period/section and may be turned off during a time period/section that is approximately 30% of the cooling power supply time period/section (FIG. 12B). When the command cooling power value is 0.5 times greater than the maximum-efficiency operation cooling power value of the compressor, the motor 40 may be turned on during a time period/section that is approximately 50% of the cooling power supply time period/section and may be turned off during a time period/section that is approximately 50% of the cooling power supply time period/section (FIG. 12D).

Details provided with reference to FIGS. 10 to 12 may be as follows.

The apparatus 900 (for controlling a compressor) may control the motor 40 such that the motor 40 repeats quick turn-on and turn-off operations during the cooling power supply time period (or section). In this case, the piston 36 may keep reciprocating using elastic energy in the motor's turn-off time period (or section). Accordingly, during the entire cooling power supply time period (or section), the piston 36 may reciprocate using electric energy (a turn-on time period/section) or elastic energy (a turn-off time period/section), and during the entire cooling power supply time period (or section), the compressor 302 may continue to compress refrigerant. Thus, the compressor may satisfy the conditions for driving a refrigerator.

Additionally, when the piston 36 reciprocates again using electric energy in a state in which the piston 36 keeps reciprocating using elastic energy, friction loss of the piston 36 may be reduced. Similarly, static friction is greater than kinetic friction. As the motor 40 is turned on based on the maximum-efficiency operation cooling power value in a state in which the friction loss is reduced, the apparatus 900 (for controlling a compressor) may control the compressor 302 such that the compressor 302 is driven with higher efficiency. As such, the compressor 302 may operate with maximum efficiency. Thus, maximum efficiency of the compressor 302 may be ensured in a wide cooling power variation range.

The apparatus 900 (for controlling a compressor) may change the first ratio (a1/a2) of the motor's turn-on time period (a1) to the motor's turn-off time period (a2) and drive the compressor 302 to satisfy the command cooling power value requested by the controller. That is, the apparatus 900 (for controlling a compressor) may set the first ratio based on the command cooling power value and the maximum-efficiency operation cooling power value of the compressor such that the average cooling power value during the cooling power supply time period (or section) follows the command cooling power value. In one embodiment, the first ratio (a1/a2) may be set in proportion to a second ratio (b1/b2) of a command cooling power value (b1) to a value (b2) calculated by subtracting the command cooling power value from the maximum-efficiency operation cooling power value.

Figure 13:
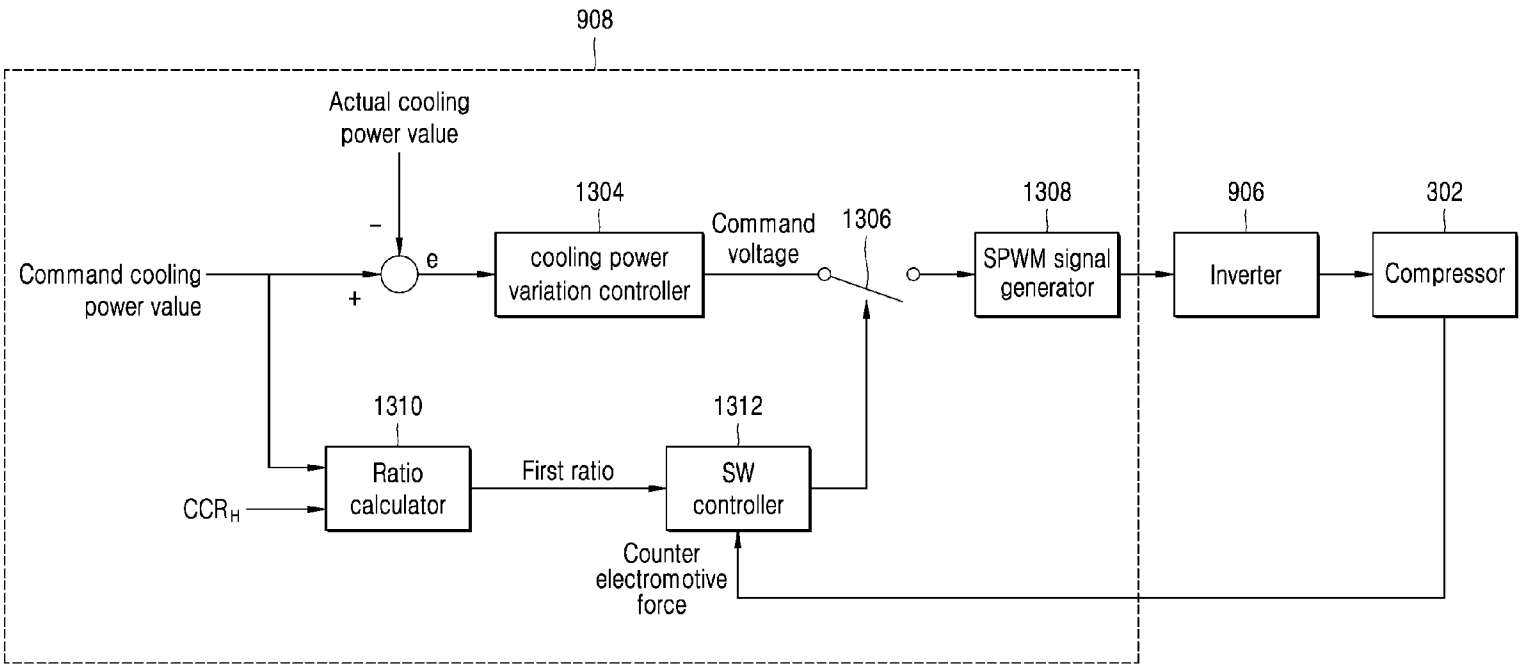
FIG. 13 is a block diagram of a compressor controller in one embodiment.

The compressor controller 908 performing the above-described operations may be described hereunder with reference to FIG. 13.

FIG. 13 is a block diagram showing a compressor controller 908 in one embodiment. Referring to FIG. 13, the compressor controller 908 may include a calculator 1302 (or calculator device), a cooling power variation controller 1304, a first switching element 1306 (or first switch), an SPWM signal generator 1308, a ratio calculator 1310 (or ratio calculator device) and a software (SW) controller 1312. Each of these components may include at least hardware.

The calculator 1302 (or calculator circuit) may perform a subtraction operation on a previous actual cooling power value feedbacked and the command cooling power value of the compressor 302 received from the controller (or main controller). That is, the calculator 1302 may be a subtraction unit. The calculator 1310 may output a cooling power error value e that is a difference between the command cooling power value and the previous cooling power value.

The cooling power variation controller 1304 (or controller) may receive the cooling power error value e, and based on the cooling power error value e, may output a command voltage value. The command voltage value may correspond to a reference voltage value required for generating a first control signal to be supplied to the inverter 906, and based on the command voltage value, cooling power may vary.

The switching element 1306 may selectively deliver a command voltage to the SPWM signal generator 1308. The switching element 1306 may be hardware, such as a switch. When the switching element 1306 is turned on, the command voltage may be delivered to the SPWM signal generator 1308, and when the switching element 1306 is turned off, the command voltage may not be delivered to the SPWM signal generator 1308. Based on the switching element 1306, the motor 40 can quickly repeat the turn-on and turn-off. The switching element 1306 may be turned on and turned off by an SW controller 1312 described hereunder. The switching element 1306 may be a semiconductor element, and for example, may be an IBGT.

The SPWM signal generator 1308, part of which is hardware, may generate a SPWM signal based on the command voltage selectively delivered by the switching element 1306. The SPWM signal may be delivered to the inverter 906 and may be used to control the turn-on and turn-off of at least one of switching elements in the inverter 906.

The inverter 906 may be controlled by the SPWM signal in the present disclosure, but is not limited to this example. The inverter 906 may also be controlled based on a PWM signal, for example.

The ratio calculator 1310 and the SW controller 1312 may be hardware components that generate a second control signal for controlling the turn-on and turn-off of the switching element 1306 (or switch).

The ratio calculator 1310, at least part of which is hardware, may receive the compressor's command cooling power value and $CCR_H$ corresponding to the maximum-efficiency operation cooling power value of the compressor 302. Additionally, based on the received command cooling power value and $CCR_H$, the ratio calculator 1310 may calculate a first ratio which is a ratio of the motor's turn-on time period (or section) to the motor's turn-off time period (or section) within the cooling power supply time period (or section).

The ratio calculator 1310, as described above, may calculate the first ratio in proportion to a second ratio which is a ratio of the command cooling power value b1 to a value b2 calculated by subtracting the command cooling power value from the maximum-efficiency operation cooling power value.

The SW controller 1312 may be a controller, at least part of which is hardware, that controls operations of the switching element 1306 (or switch). The SW controller 1312 may receive the first ratio calculated by the ratio calculator 1310 and a counter electromotive force of the motor 40. The counter electromotive force may be used to ascertain a stroke of the piston 36. Additionally, the SW controller 1312 may generate a second control signal based on the first ratio and the counter electromotive force, and may provide the second control signal to the switching element 1306.

That is, the second control signal supplied to the switching element 1306 may be a control signal for determining time points, or times, at which the switching element 1306 is turned on and turn off. Accordingly, based on the first ratio included in the second control signal, time sections (or time periods), in which the motor 40 is turned on and turned off in the cooling power supply time section (or period), may be determined, and based on the counter electromotive force included in the second control signal, time points, at which the turn-off of the motor 40 ends and the turn-on of the motor 40 starts in the cooling power supply time section (or pattern), may be determined.

In one embodiment, the SW controller 1312 in the compressor controller 908 may determine the time point at which the turn-off ends (i.e., a time point for ending an elastic energy-driven control section) and the time point at which the turn-on starts (i.e., a time point for starting an electric energy-driven control section), based on the stroke (position) of the piston 36 ascertained using the counter electromotive force.

FIG. 14 is a view for describing a concept of setting a time point for ending an elastic energy-driven control section of a piston 36 in one embodiment. In FIG. 14, the counter electromotive force may correspond to a stroke of the piston 36. In this case, when the counter electromotive force reaches a zero crossing point, the piston 36 may be placed at the TDC or the BDC.

Figure 14A:
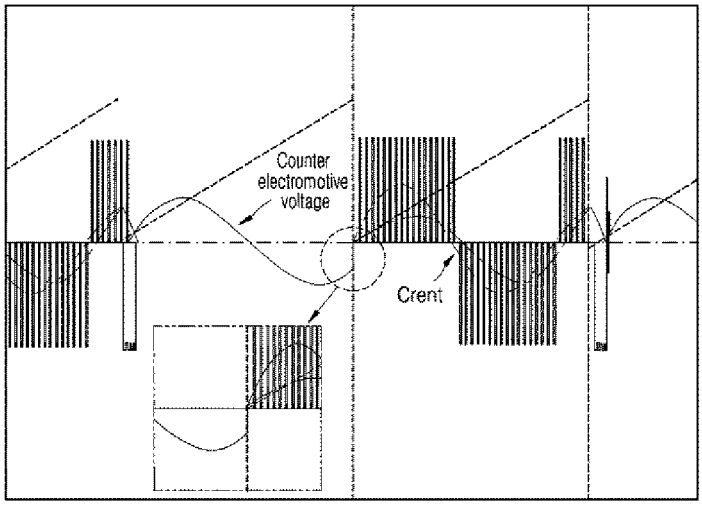
FIGS. 14A and 14B are views for describing a concept of setting a time point for ending an elastic energy-driven control section of a piston in one embodiment.

FIG. 14A shows a configuration of setting a time point for ending an elastic energy-driven control section without using the counter electromotive force, i.e., the stroke of the piston 36. Referring to FIG. 14A, at a point at which the elastic energy-driven control section ends, the counter electromotive force may not reach the zero crossing point, and this denotes that the piston 36 is not placed at the TDC or the BDC. When driving current is supplied to the motor 40 in a state in which the piston 36 is not placed at the TDC or the BDC, variation in force applied to the piston 36 may be considerable. Accordingly, power factor of the motor 40 may be reduced, and noise may be generated during reciprocation of the piston 36.

Figure 14B:
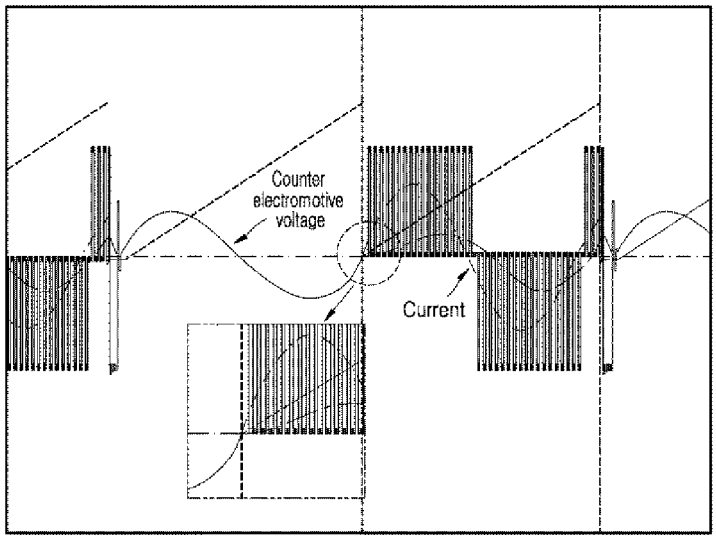

FIG. 14B shows a configuration of setting a time point for ending an elastic energy-driven control section using the counter electromotive force, i.e., the stroke of the piston 36. Referring to FIG. 14B, the compressor controller 908 in one embodiment may allow driving current to be supplied to the motor 40 when the counter electromotive force detected in the elastic energy-driven control section reaches the zero crossing point. That is, when the counter electromotive force reaches the zero crossing point, the piston 36 may be placed at the TDC or the BDC, and when the piston 36 is placed at the TDC or the BDC, driving current may be supplied to the motor 40, to end the elastic energy-driven control section. Accordingly, variation in force applied to the piston 36 may be minimized, the compressor 302 may operate to have a maximum power factor (i.e., "1), and noise generated during reciprocation of the piston 36 may be reduced.

The compressor 302 may perform a compression operation for generating cooling power in a plurality of cooling power supply time sections. In this case, in each cooling power supply time section, the command cooling power value may differ, and the duration and number of the elastic energy-driven control section (i.e., the motor 40'*s* turn-off time section) may differ. In one embodiment, the apparatus 900 for controlling a compressor may update the first ratio in each cooling power supply time section.

Figure 15:
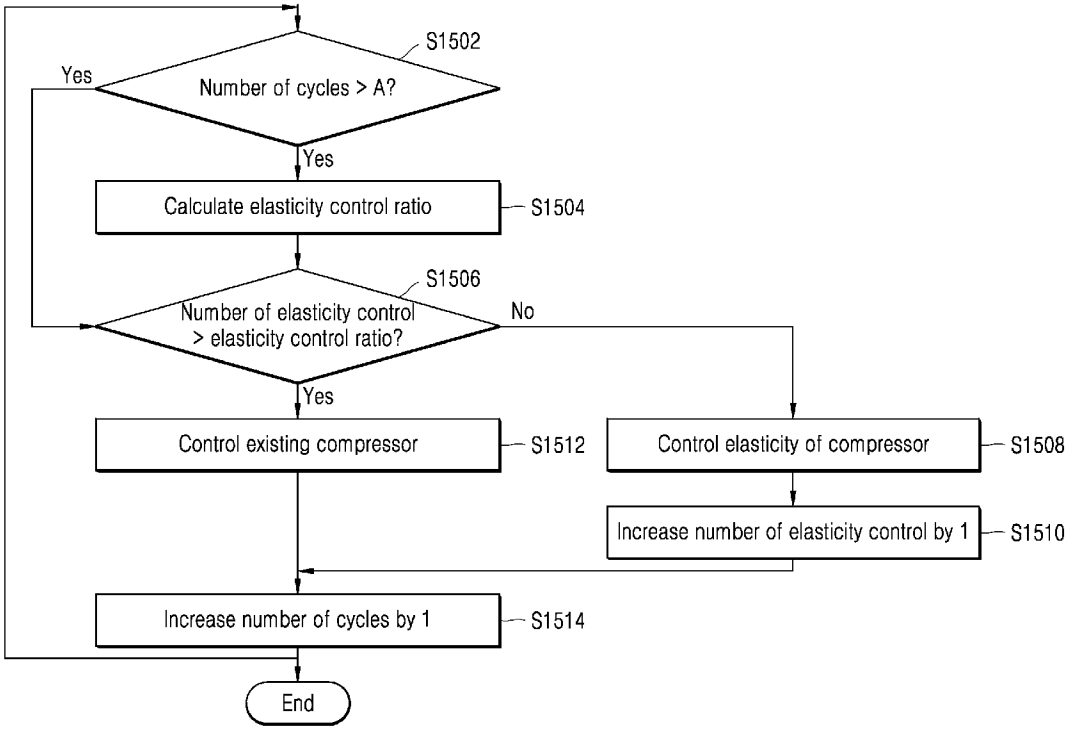
FIG. 15 is a flow chart showing an operation of the compressor controller that updates a first ratio, in one embodiment.

A process of updating the first ratio is described with reference to FIG. 15. FIG. 15 is a flow chart showing an operation of the compressor controller 908 that updates a first ratio in one embodiment. In S1502, the compressor controller 908 may ascertain whether the number of cycles exceeds a predetermined critical number A.

The number of cycles may correspond to the number of changes in the turn-on/turn-off of the motor 40. That is, a cycle may correspond to the turn-on or turn-off of the motor 40. When the turned-on motor 40 is turned off, or when the turned-off motor 40 is turned on, the number of cycles may increase by "1". The critical number A may correspond to a total number of cycles included in the cooling power supply time section.

When the number of cycles exceeds the critical number A, the compressor controller 908 may calculate an elasticity control ratio in S1504. The elasticity control ratio may correspond to the first ratio of the motor's turn-on time section to the motor's turn-off time section. That is, in S1504, the elasticity control ratio may be updated.

When the number of cycles does not exceed the critical number A, S1506 may be carried out instead of S1504. That is, when the number of cycles does not exceed the critical number A, the elasticity control ratio is not updated. In S1506, the compressor controller 908 may ascertain whether the number of elasticity control exceeds the elasticity control ratio. The elasticity control ratio may correspond to a target value of elasticity control based on the first ratio. For example, when the critical number A is 10, the ratio of the motor's turn-off time section, corresponding to the first ratio, is 50%, the target value of elasticity control may be "5".

When the number of elasticity control does not exceed the elasticity control ratio, in S1508, the compressor controller 908 may control the compressor 302 such that the compressor is elastically controlled. That is, the elasticity control in S1508 may correspond to the turn-off of the motor 40. Then, the compressor controller 908 may increase the number of elasticity control by 1 in S1510.

When the number of elasticity control exceeds the elasticity control ratio, the compressor controller 908 may control the compressor 302 using existing compressor control in S1512. The existing compressor control denotes that the SW controller 1312 supplies no second control signal to the switching element 1308 and that the switching element 1308 is always turned on in FIG. 13. Finally, in S1514, the compressor controller 908 may increase the number of the cycles by 1. Then the compressor controller 908 may return to S1502.

Figure 16:
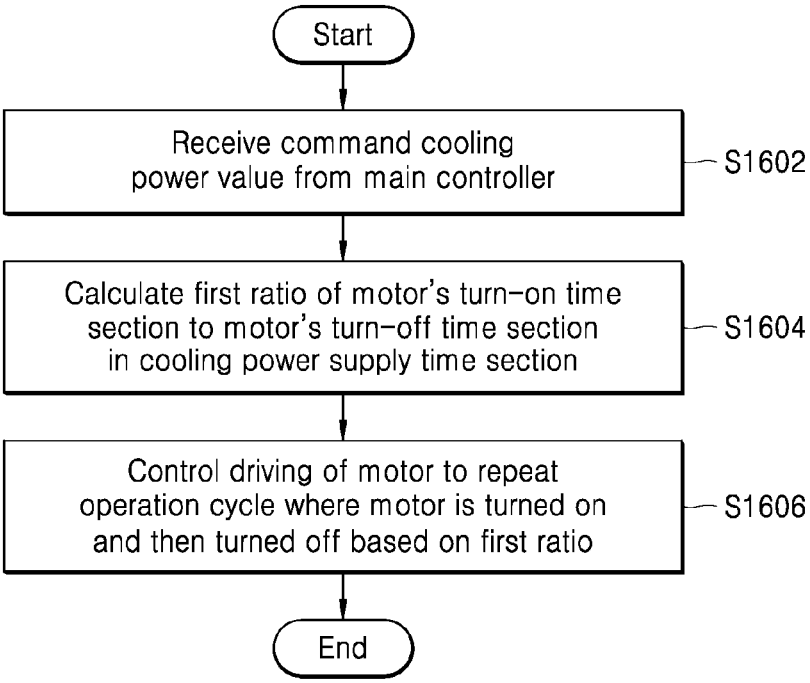
FIG. 16 is a flow chart showing a method for controlling a compressor in one embodiment.

FIG. 16 is a flow chart showing a method for controlling a compressor 302 in one embodiment. The above method may be carried out by the compressor controller 908 of the apparatus 900 for controlling a compressor.

In S1602, a command cooling power value may be received from the main controller. In S1604, a first ratio of the motor's turn-on time section to the motor's turn-off time section in a cooling power supply time section may be calculated, based on the command cooling power value and a maximum-efficiency operation cooling power value of the compressor.

In S1606, driving of the motor 40 may be controlled such that the motor 40 repeats an operation cycle in which the motor 40 is turned on and then turned off, based on the first ratio, in the cooling power supply time section.

In this case, when the motor 40 is turned on, the compressor 302 may be driven based on the maximum-efficiency operation cooling power value, and the piston 40 may reciprocate using electric energy supplied by the motor 40. Additionally, when the motor 40 is turned off, the piston 36 may reciprocate using inertial energy or elastic energy.

The configuration of the apparatus 900 for controlling a compressor described with reference to FIGS. 9 to 15 may also be applied to the configuration of the method for controlling a compressor described with reference to FIG. 16. Detailed description in relation to this is omitted.

The embodiments according to the present disclosure may be implemented in the form of program instructions to be executed through a variety of computer devices so as to be recorded on a computer-readable recording medium. The computer-readable recording medium may include program instructions, data files, data structures and the like independently or a combination thereof.

The present disclosure is directed to an apparatus and a method for controlling a compressor that may vary cooling power while keeping a compressor operating with maximum efficiency.

The present disclosure is also directed to an apparatus and a method for controlling a compressor that may control a compressor such that the compressor compresses refrigerant in a cooling power supply time section although driving current is not supplied to the compressor.

The present disclosure is also directed to an apparatus and a method for controlling a compressor that may help to reduce noise generated during operation of a compressor.

The present disclosure is also directed to an apparatus and a method for controlling a compressor that may help to improve power factor of a compressor.

In an apparatus and a method for controlling a compressor of one embodiment, a motor included in a compressor may be controlled such that the motor repeats turn-on and turn-off operations quickly in a cooling power supply time section, thereby enabling the compressor to compress refrigerant in the cooling power supply time section.

In the apparatus and method for controlling a compressor of one embodiment, while driving of the motor may be controlled to repeat an operation cycle, in which the motor is turned on and then turned off, in the cooling power supply time section, a piston may reciprocate using electric energy when the motor is turned on, and the piston may reciprocate using inertial energy or elastic energy when the motor is turned off.

In the apparatus and method for controlling a compressor of one embodiment, a first ratio of the motor's turn-on time section to the motor's turn-off time section in the cooling power supply time section may be set based on a command cooling power value for the compressor and a maximum-efficiency operation cooling power value of the compressor, thereby enabling a refrigerator to operate in a way that satisfies the command cooling power value.

In the apparatus and method for controlling a compressor of one embodiment, the piston may be controlled such that the piston reciprocates in the motor's turn-off time section of the cooling power supply time section, thereby reducing friction loss of the piston.

In the apparatus and method for controlling a compressor of one embodiment, a position of the piston may be ascertained based on a counter electromotive force detected in the motor, thereby improving power factor of the compressor and reducing noise generated during operation of the compressor.

An apparatus for controlling a compressor including a piston and a motor, in one embodiment, may include a rectifier configured to rectify AC power input from an external power source and output the rectified power, an inverter configured to convert a DC voltage output from the rectifier into an AC voltage and to supply the AC voltage to the motor, and a compressor controller configured to adjust the AC voltage supplied to the motor and to control a reciprocating movement of the piston. The compressor controller may control driving of the motor in a cooling power supply time section to repeat an operation cycle in which the motor is turned on and then turned off, and the piston reciprocates based on inertial energy in a turn-off time section of the motor. A first ratio of a turn-on time section of the motor and the turn-off time section of the motor is set based on a command cooling power value for the compressor and a maximum-efficiency operation cooling power value of the compressor.

According to the present disclosure, a motor may be controlled such that the motor repeats turn-on and turn-off operations quickly, and the compressor may continue to compress refrigerant, thereby enabling the compressor to satisfy conditions for driving a refrigerator.

According to the present disclosure, a turn-on time section and a turn-off time section of the motor may be set based on a command cooling power value and a maximum-efficiency operation cooling power value of the compressor, thereby enabling a refrigerator to satisfy the command cooling power value.

According to the present disclosure, friction loss of a piston, caused in a cooling power supply time section, may be reduced, thereby improving efficiency of the compressor.

The components and features and the like are described above with reference to the limited embodiments and accompanying drawings set forth herein for a better understanding of the subject matter in the present disclosure. However, the disclosure is not intended to limit the embodiments set forth herein. The embodiments may be modified and changed in various different ways by one skilled in the art within the technical scope of the disclosure. Therefore, the technical spirit of the disclosure should not be construed as being limited by the embodiments herein, and equivalents and equivalent modifications drawn from the scope of the claims should be included in the scope of the technical spirit of the disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for controlling a compressor that includes a piston and a motor, comprising:

a rectifier configured to receive AC power and to output DC power;

an inverter configured to convert the DC voltage from the rectifier into an AC voltage, and to provide the AC voltage to the motor; and a controller configured to control the AC voltage to be provided to the motor and to control reciprocating movement of the piston, wherein the controller is configured to control driving of the motor during a cooling power supply time period that includes a turn-on time period of the motor and a turn-off time period of the motor, wherein during the cooling power supply time period, the driving of the motor to repeat an operation cycle in which the motor is turned on and turned off, wherein during the turn-off time period of the motor, the piston is to move based on inertial energy, and wherein the controller is configured to control driving of the motor based on a first ratio that is set based on a command cooling power value of the compressor and a maximum-efficiency operation cooling power value of the compressor, wherein the first ratio is based on the turn-on time period and the turn-off time period, wherein during the turn-on time period of the motor, the compressor is configured to be driven based on the maximum-efficiency operation cooling power value, and the piston is configured to move based on electric energy, and wherein the first ratio is in proportion to a second ratio, the second ratio is a ratio based on the command cooling power value and a value determined by subtracting the command cooling power value from the maximum-efficiency operation cooling power value.

2. The apparatus of claim 1, wherein an average cooling power value during the cooling power supply time period is based on the command cooling power value.

3. The apparatus of claim 1, wherein the compressor includes a spring configured to elastically support the piston, and the inertial energy for movement of the piston is based on elastic energy provided by elasticity of the spring and mass of the piston.

4. The apparatus of claim 3, wherein a duration of the turn-off time period of the motor is based on a duration less than a resonance frequency period of the spring.

5. The apparatus of claim 1, wherein the controller is configured to:

determine a position of the piston based on a counter electromotive force in the motor, and determine an end time of the turn-off time period of the motor and a start time of the turn-on time period of the motor based on the determined position of the piston.

6. The apparatus of claim 5, wherein the controller is configured to:

determine time points in which the piston is to be provided at dead centers based on the end time of the turn-off time period of the motor and the start time of the turn-on time period of the motor.

7. The apparatus of claim 6, wherein the dead centers include a top dead center (TDC) and a bottom dead center (BDC).

8. The apparatus of claim 5, the controller is configured to:

output a cooling power error value by performing an operation on the command cooling power value and an actual cooling power value;

generate a command voltage based on the cooling power error value;

selectively deliver the command voltage;

generate a first control signal for controlling driving of the compressor based on the selectively delivered command voltage;

determine the first ratio based on the command cooling power value and the maximum-efficiency operation cooling power value; and generate a second control signal for controlling turn-on and turn-off of a switching element based on the first ratio and the counter electromotive voltage, and send the second control signal to the switching element.

9. The apparatus of claim 1, wherein the maximum-efficiency operation cooling power value of the compressor corresponds to a cooling capacity ratio at maximum efficiency of the compressor.

10. The apparatus of claim 1, wherein the command cooling power value is received from another controller that communicates with the controller of the compressor.

11. The apparatus of claim 1, wherein the controller is configured to change the first ratio so as to separately correspond to one of a plurality of the cooling power supply time periods.

12. A method for controlling a compressor performed by a controller wherein the compressor includes a piston and a motor, comprising:

receiving a command cooling power value;

determining a first ratio based on a cooling power supply time period that includes a turn-on time period of the motor and a turn-off time period of the motor, wherein the first ratio is a ratio of the turn-on time period of the motor and the turn-off time period of the motor based on the command cooling power value of the compressor and a maximum-efficiency operation cooling power value of the compressor; and controlling driving of the motor during the cooling power supply time period so as to repeat an operation cycle in which the motor is turned on and turned off based on the first ratio, wherein, during the turn-on time period, the compressor is driven based on the maximum-efficiency operation cooling power value, and the piston is to linearly move based on electric energy provided by the motor, wherein, during the turn-off time period, the piston is to linearly move based on inertial energy, wherein determining the first ratio comprises setting the first ratio in proportion to a second ratio, and wherein the second ratio is a ratio of the command cooling power value and a value determined by subtracting the command cooling power value from the maximum-efficiency operation cooling power value.

13. The method of claim 12, wherein an average cooling power value during the cooling power supply time period follows the command cooling power value.

14. The method of claim 12, wherein controlling driving of the motor comprises:

determining a position of the piston based on a counter electromotive force in the motor; and determining an end time of the turn-off time period of the motor and a start time of the turn-on time period of the motor based on the determined position of the piston.

15. An apparatus for controlling a compressor, the apparatus comprising:

an inverter to provide voltage to a motor of the compressor; and a controller configured to control movement of a piston of the compressor based on the voltage provided to the motor, wherein the controller is configured to control driving of the motor during a cooling power supply time period that includes a turn-on time period of the motor and a turn-off time period of the motor, wherein during the turn-on time period of the motor, the piston is to move based on electric energy, wherein during the turn-off time period of the motor, the piston is to move based on inertial energy or elastic energy, and wherein the controller is configured to control driving of the motor based on a first ratio, wherein the first ratio is based on the turn-on time period of the motor and the turn-off time period of the motor, wherein during the turn-on time period of the motor the compressor is configured to be driven based on a maximum-efficiency operation cooling power value of the compressor, and the piston is configured to move based on electric energy, and wherein the first ratio is in proportion to a second ratio, the second ratio is a ratio based on a command cooling power value of the compressor and a value determined by subtracting the command cooling power value from the maximum-efficiency operation cooling power value.

16. The apparatus of claim 15, wherein the controller is configured to:

determine a position of the piston based on a counter electromotive force in the motor, and determine an end of the turn-off time period of the motor and a start of the turn-on time period of the motor based on the determined position of the piston.

17. The apparatus of claim 16, wherein the controller is configured to:

determine time points in which the piston is to be provided at dead centers based on the end of the turn-off time period of the motor and the start of the turn-on time period of the motor.

* * * * *